US006332303B1

(12) United States Patent
Saito

(10) Patent No.: US 6,332,303 B1
(45) Date of Patent: Dec. 25, 2001

(54) METHOD OF BUILDING UNDERGROUND STRUCTURE

(75) Inventor: Takaharu Saito, Yokohama (JP)

(73) Assignee: NIC Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/544,288

(22) Filed: Apr. 6, 2000

(30) Foreign Application Priority Data

Feb. 28, 2000 (JP) ..... 12-50822

(51) Int. Cl.[7] ..... E04B 1/16; E04G 21/00

(52) U.S. Cl. ..... 52/741.14; 52/742.14; 52/169.6; 52/296; 52/745.1; 405/229; 405/231; 405/232

(58) Field of Search ..... 52/123.1, 169.6, 52/174, 175, 250, 293.2, 296, 299, 414, 741.14, 742.14, 745.09, 745.1; 405/229, 231, 232

(56) References Cited

U.S. PATENT DOCUMENTS 5,944,453 * 8/1999 Gryba ..... 405/223

FOREIGN PATENT DOCUMENTS

H10-8476 * 1/1998 (JP) ..... E02D/29/00
2828954 9/1998 (JP) .
282954 9/1998 (JP) .

* cited by examiner

*Primary Examiner*—Carl D. Friedman
*Assistant Examiner*—U. Slack
(74) *Attorney, Agent, or Firm*—Oblon, Spivak, McClelland, Maier & Neustadt, P.C.

(57) ABSTRACT

A method of building an underground structure using concrete columns to be vertically installed at corners and at positions between the corners and concrete panels to be filled between adjacent concrete columns. The method comprises the steps of determining positions for the concrete columns, digging a trench for a guide composed of outer and inner frames, drilling holes for the columns, the holes being deeper than a level where the concrete panels are placed, installing the columns into the holes and setting with concrete, removing the outer frame of the guide, deepening the trench, fitting concrete panels between the columns, installing a reinforcing metal beam using concrete on the columns and panels to prevent inward buckling, and removing the inner frame of the guide after the concrete on the reinforcing beam has set.

5 Claims, 22 Drawing Sheets

METHOD OF BUILDING UNDERGROUND STRUCTURE

BACKGROUND OF THE INVENTION

1. Field of the Invention

This invention relates to a method of building an underground structure, and more particularly to a method of building an underground structure composed of vertical corner columns and vertical concrete columns provided between the corner columns, and concrete panels fitted between adjacent columns. The concrete panels are moved downward while digging the ground under them.

2. Description of the Related Art

In the related art, an underground structure is usually built in the following manner. Concrete columns are vertically installed in a dug area of a ground at positions corresponding to corners and intermediate portions of the underground structure to be built. Concrete panels are fitted between the columns while digging the ground under them to a predetermined depth. The side edges of the concrete panels are joined to the columns using bolts or the like. The bottom of the underground structure is made by applying concrete to a space defined by the concrete panels. (Refer to Japanese Patent No. 282954.)

SUMMARY OF THE INVENTION

According to the invention, there is provided a method of building an underground structure constructed with concrete columns vertically installed at corners and at positions the corners and concrete panels fitted between adjacent concrete columns. The method comprises the steps of: determining positions for installing the concrete columns, and digging a trench for burying a guide used for the concrete columns; drilling holes for burying the concrete columns in the trench, the holes being deeper than a level where the concrete panels are placed; assembling the guide, the guide being composed of outer and inner frames, and guide members for burying the concrete columns; installing the columns in the trenches along the guide, and filling concrete in the holes to fix the concrete columns in the holes; removing the outer frame of the guide; deepening the trench, digging an area for the underground structure, and moving the concrete panels down; installing a reinforcing beam on the concrete columns and the concrete panels to prevent the concrete panels from projecting inward due to soil pressure; and removing the inner frame of the guide after the reinforcing beam is hardened.

This method may further include the steps of providing a bottom of the underground structure by applying concrete on the area defined by the concrete panels, and filling a water sealant in spaces between the concrete panels and the columns, installing frames in spaces between ends of adjacent concrete panels, and filling mortar in the spaces between the concrete panels.

The method is applicable to providing an underground parking lot with a mechanical two-story lift.

The reinforcing beam extending atop the columns and panels are effective in joining them without using bolts or the like, and in preventing the panels from projecting inward due to ground pressure.

DESCRIPTION OF THE PREFERRED EMBODIMENT

Figure 1:
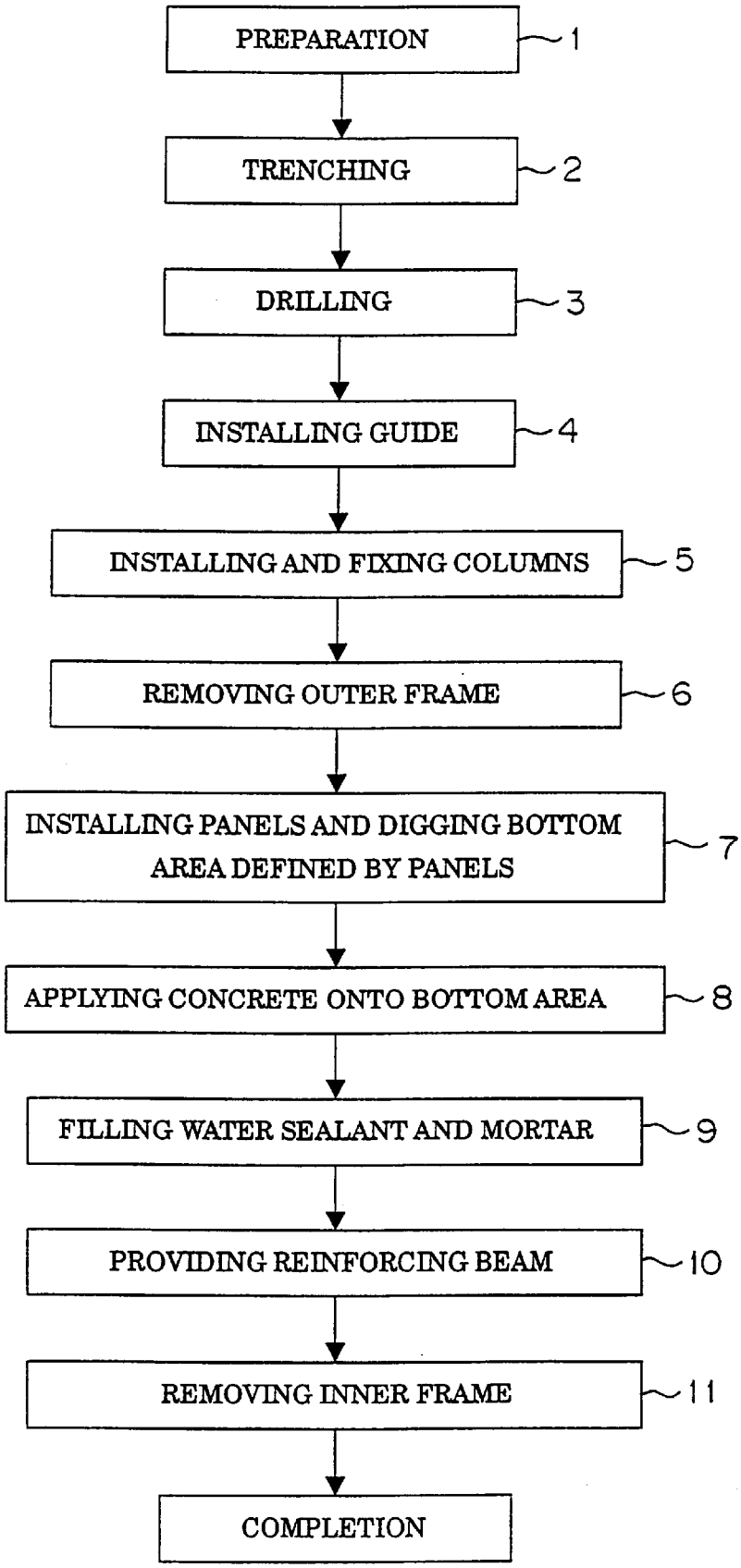
FIG. 1 shows the steps of building an underground structure according to the invention.

The method of the invention is executed in the sequence shown in FIG. 1.

(1) Preparation

First of all, spaces for storing heavy machines and installation materials are prepared at a site where an underground structure such as a cellar or a parking lot is to be built. Positions of columns and a trench N are determined. A guide R for burying the columns is placed in the trench N.

(2) Digging the Trench N

Figure 2:
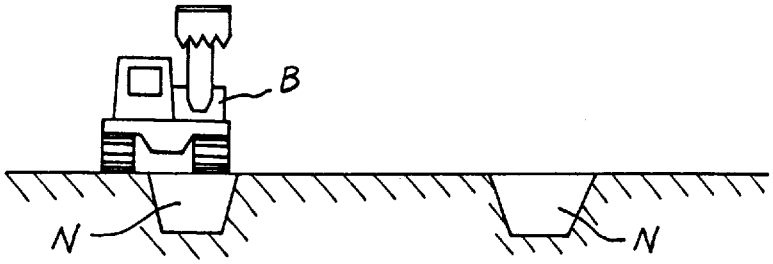
FIG. 2 shows how a trench is dug.

The trench N is dug as shown in FIG. 2 using a back hoe B. The trench N is 1.0 m deep, and wide enough to place the guide R (shown in FIG. 11) therein, as will be described later.

(3) Drilling Holes for Installing Columns

Figure 3:
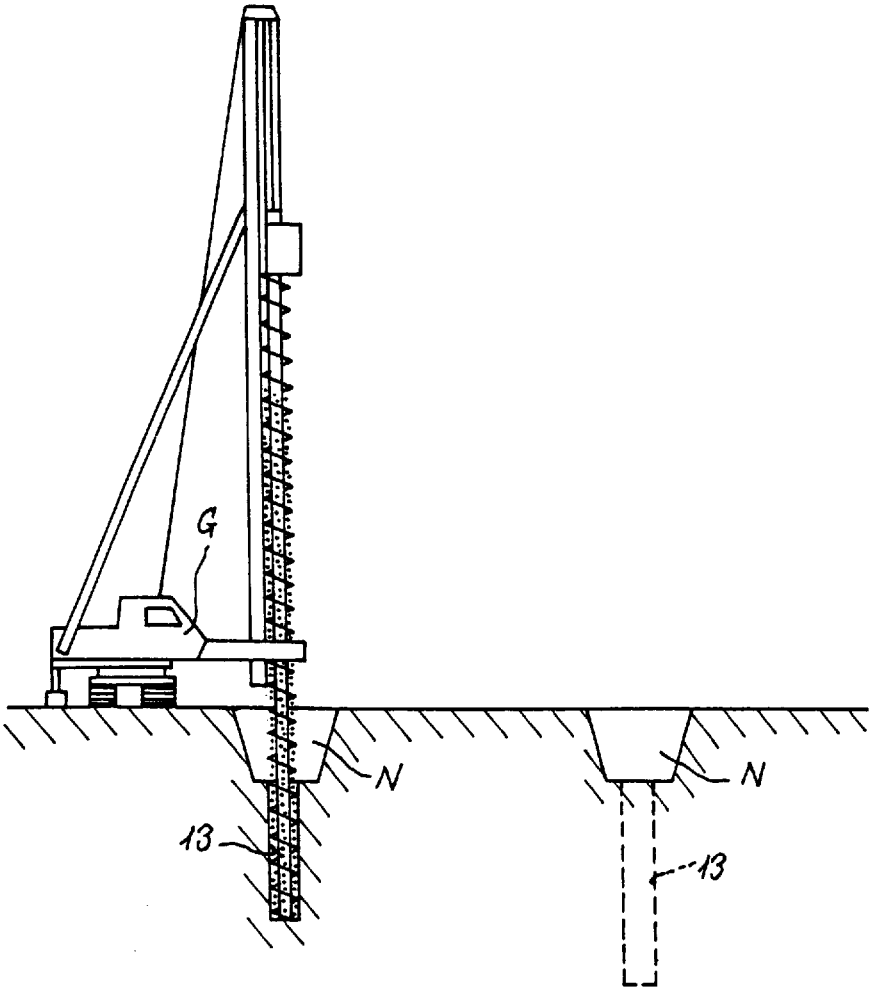
FIG. 3 shows how holes for installing columns are drilled.

Referring to FIG. 3, positions where holes 13 are drilled in the trench N are precisely measured. An auger G is used for drilling the holes 13. The holes 13 are larger than the columns, and are deep compared with a bottom part of the underground structure defined by concrete panels 80 (which will be described later with reference to FIG. 27) and shown by a broken line in FIG. 7. If a sloping area is drilled, a casing will be used in order to prevent walls of the holes from falling down.

(4) Placing the Guide R

Figure 4:
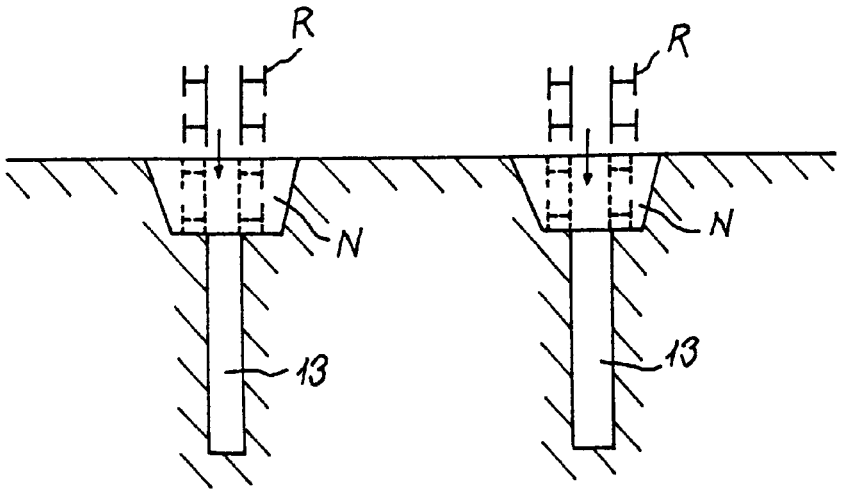
FIG. 4 shows how a guide is installed in the trench.

A guide installing area is readjusted in order to precisely position the guide R as predetermined, as shown in FIG. 4.

Figure 19:
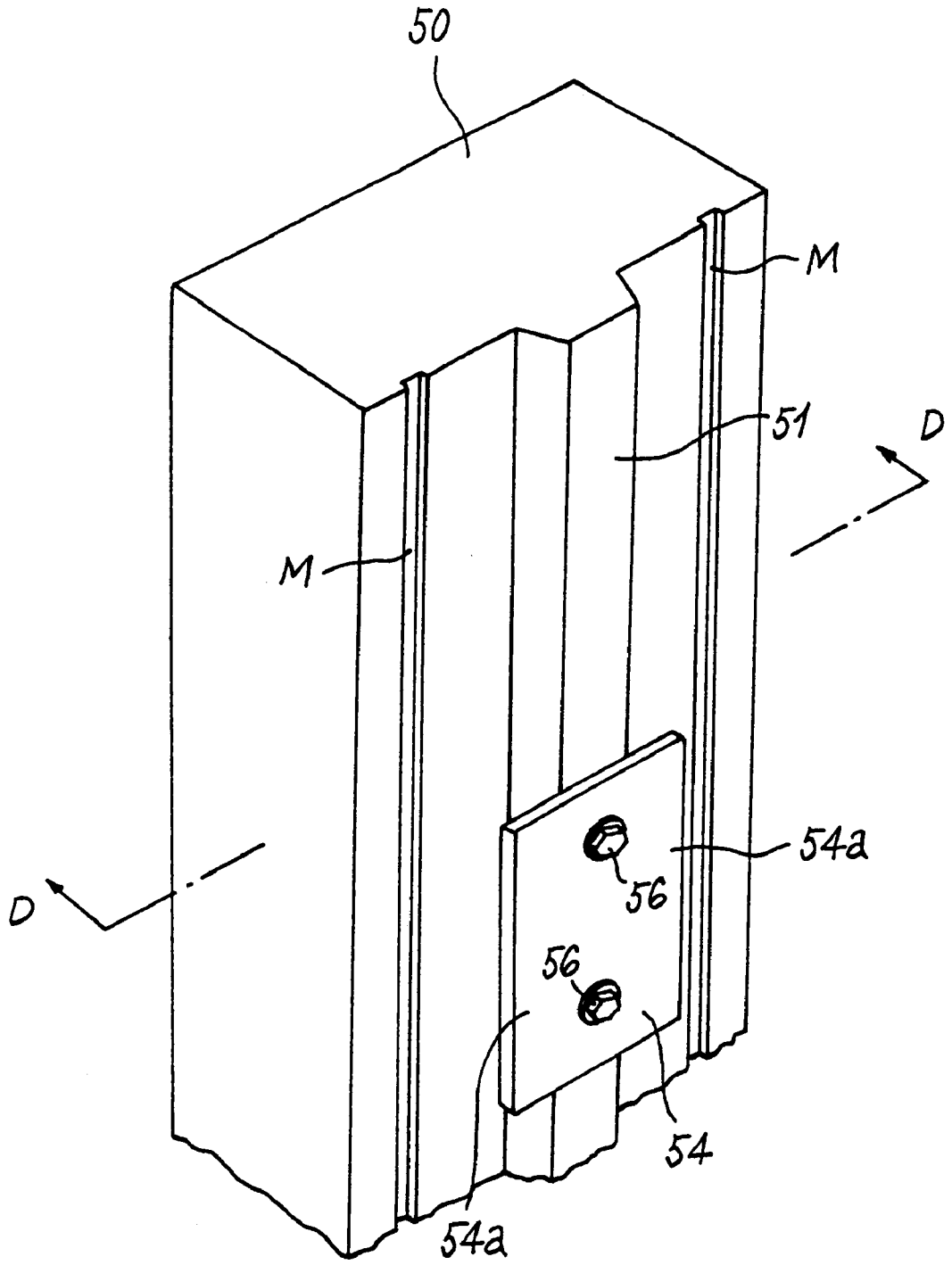
FIG. 19 is a perspective view of the column of FIG. 17.
Figure 20:
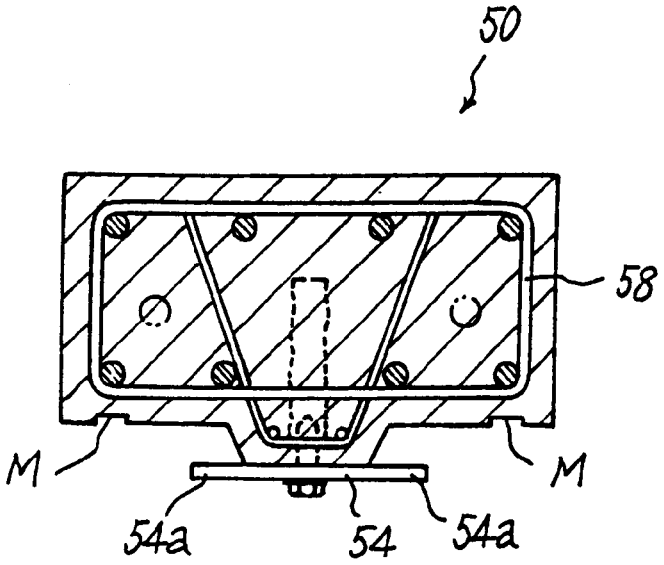
FIG. 20 is a cross section of the column taken along line D—D in FIG. 19.
Figure 21:
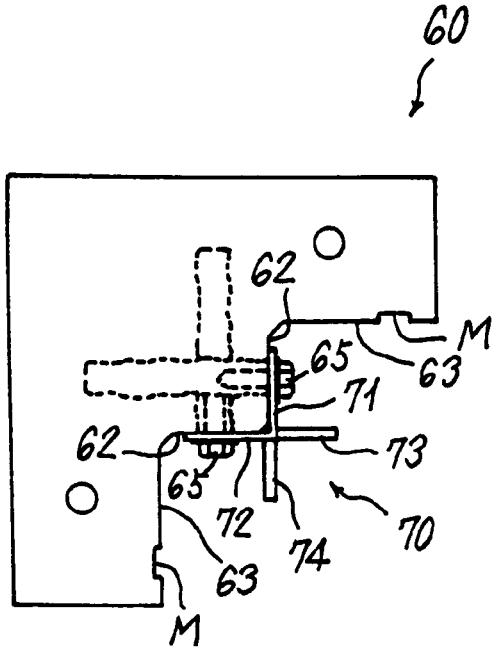
FIG. 21 is a top plan view of a corner column.
Figure 22:
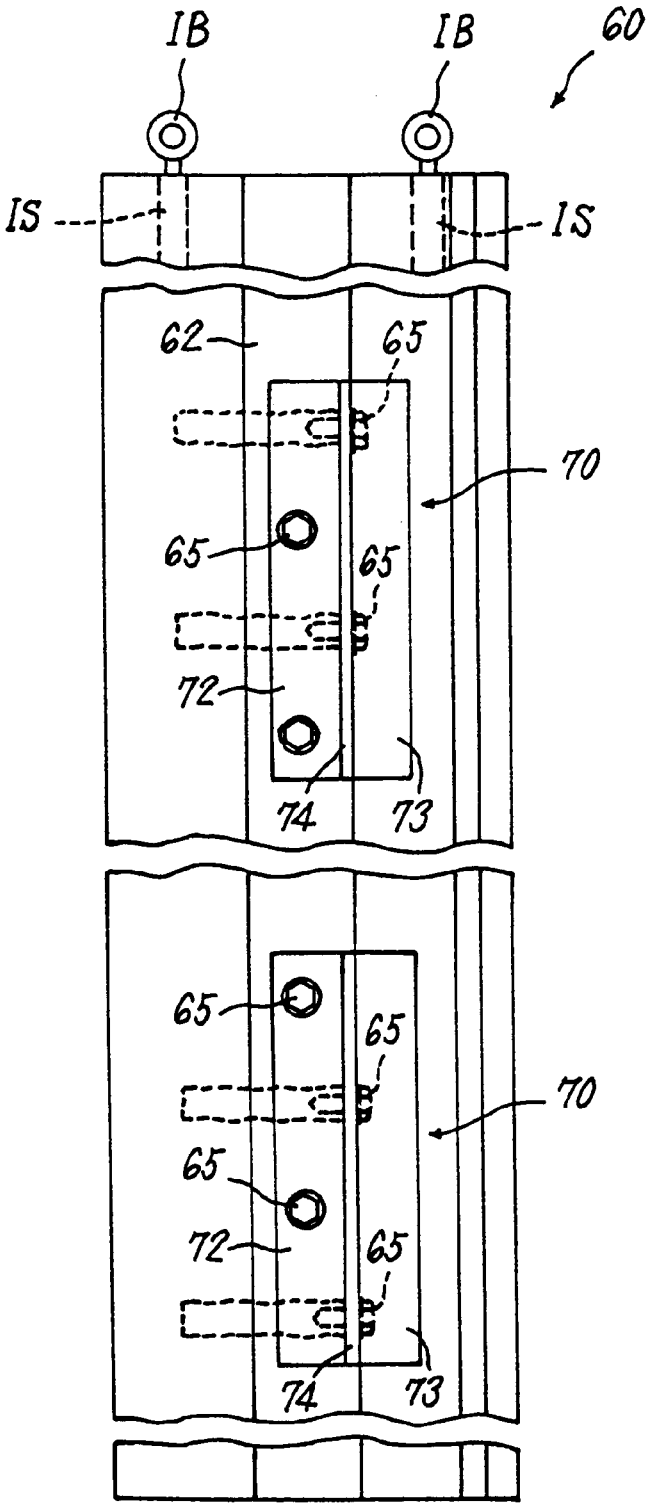
FIG. 22 is a front view of the corner column.
Figure 23:
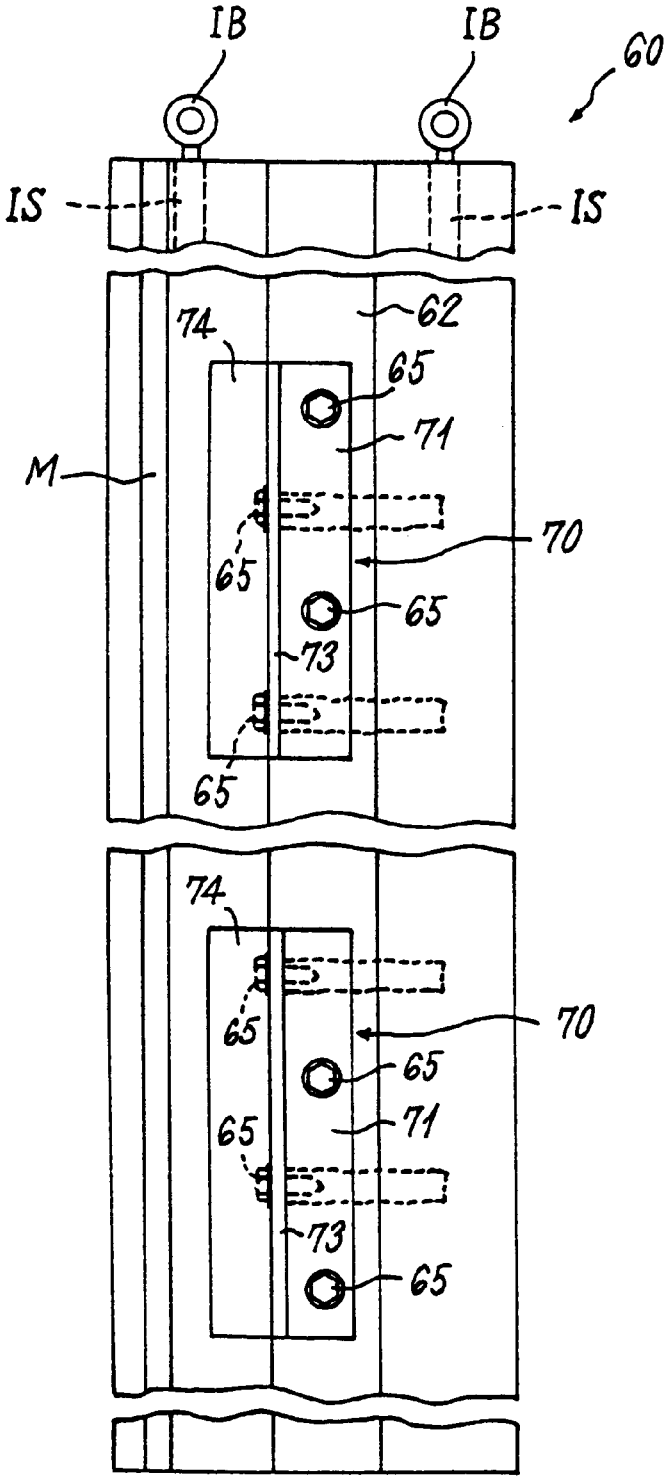
FIG. 23 is a right side cross section of the corner column.
Figure 24:
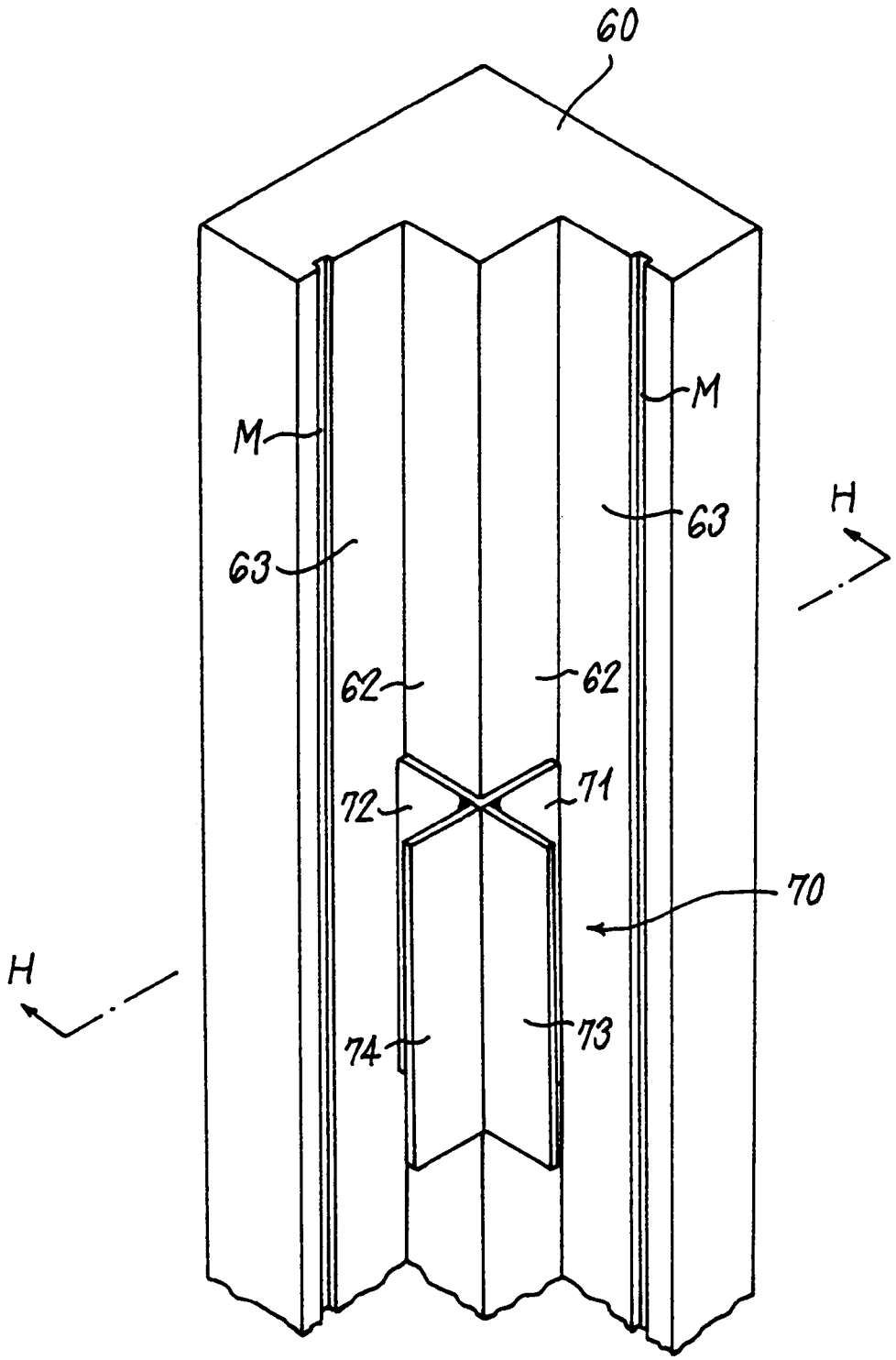
FIG. 24 is a perspective view of the corner column.
Figure 25:
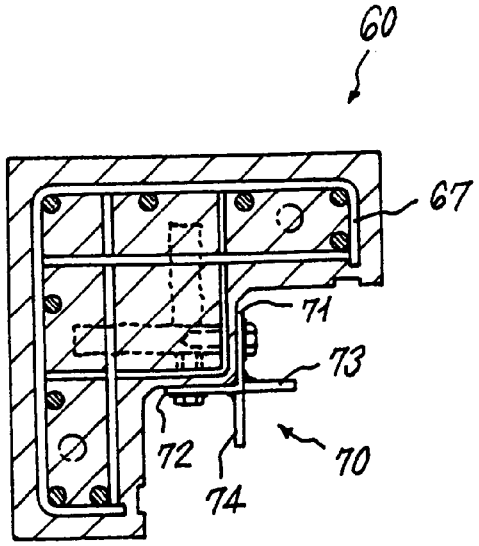
FIG. 25 is a cross section of the corner column taken along line H—H in FIG. 24.

Referring to FIGS. 11 to 16, the guide R has a double structure, and includes upper and lower guide parts 11G and 11*g* which are vertically joined. The upper guide part 11G is constituted by outer and inner frames 11A and 11B which are laterally joined. The outer frame 11A includes four H-beams 11*a*, 12*a*, 13*a* and 14*a* assembled as predetermined. The inner frame 11B includes H-beams 11*b*, 12*b*, 13*b* and 14*b*, and is smaller than the outer frame 11*a* by a depth of columns 50 which are provided between corners, and corner columns 60. These columns will be described later with reference to FIGS. 19 and 24. The lower guide part 11*g* is identical to the upper guide part 11G, and is constituted by H-beams 11*ag*, 12*ag*, 13*ag*, 14*ag*, 11*bg*, 12*bg*, 13*bg* and 14*bg* (H-beams 12*ag*, 13*ag*, 11*bg*, 12*bg* and 13*bg* are not shown in the foregoing drawings). The upper and lower guide parts 11G and 11*g* are joined using channel irons 21 to 40.

Figure 13:
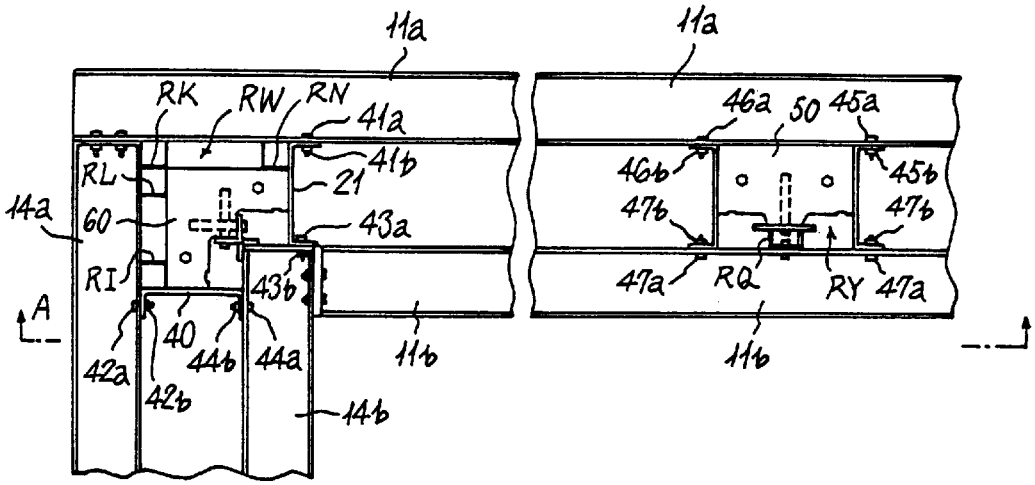
FIG. 13 is a partially enlarged top plan view of the guide.
Figure 14:
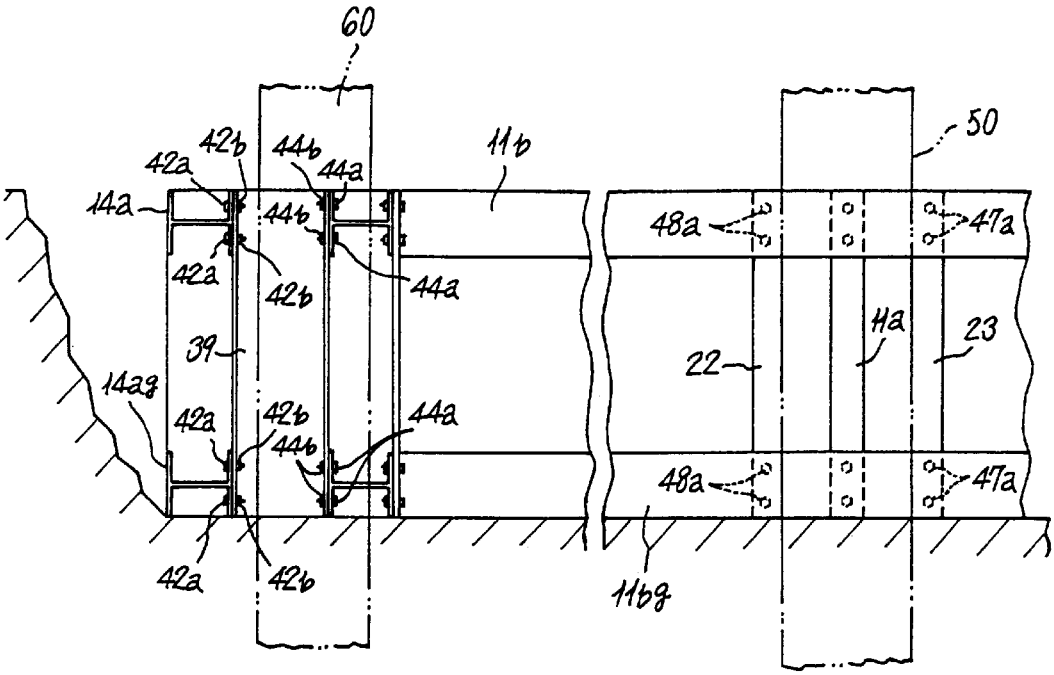
FIG. 14 is a cross sectional view of the guide taken along line A—A in FIG. 13.
Figure 15:
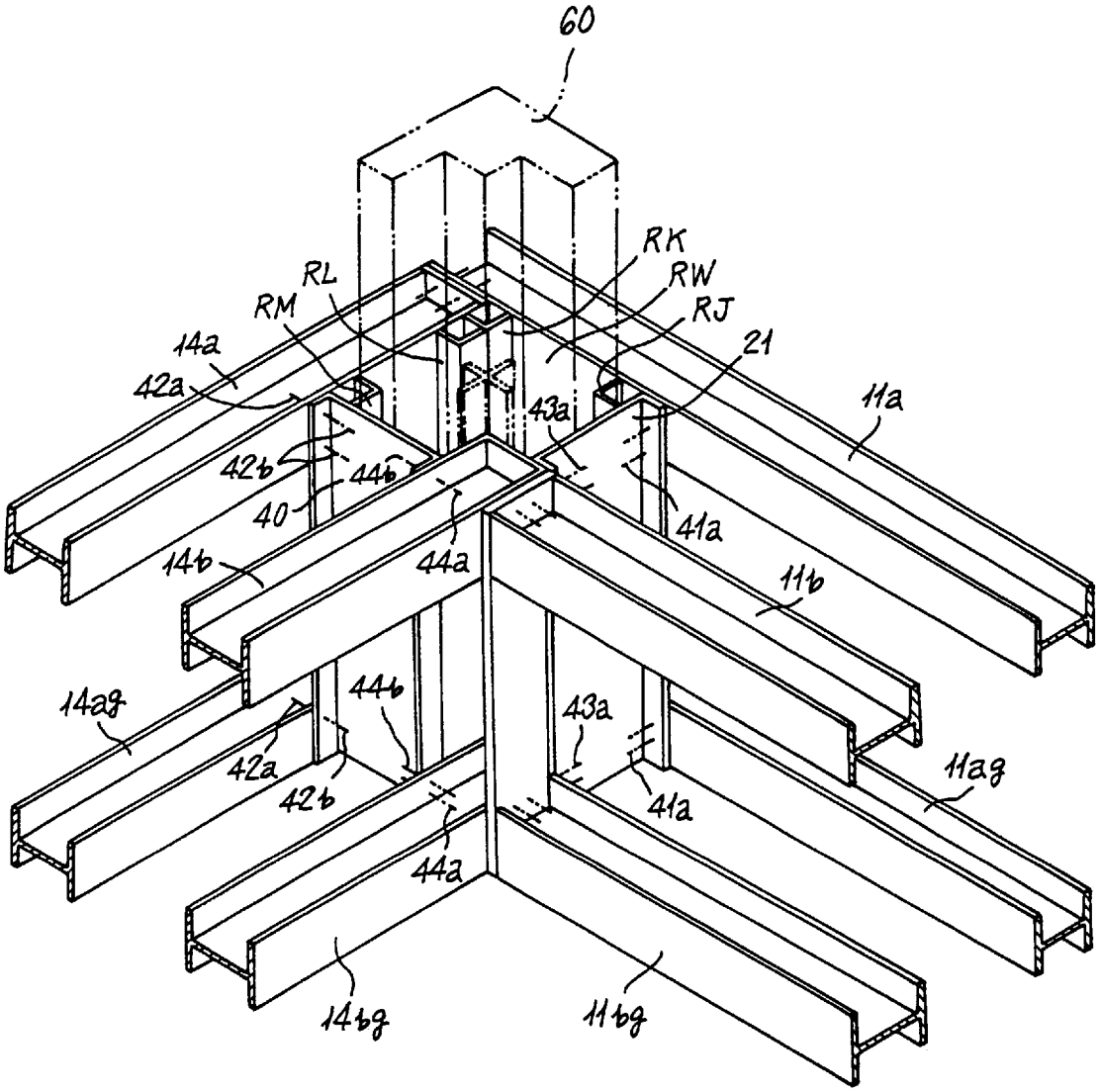
FIG. 15 is a perspective view of a part of one of corners of the guide.

Referring to FIGS. 13 and 15, the guide R is joined at corners thereof as follows. At one corner of the upper guide 11G, the H-beams 11*a* and 14*a* of the outer frame 11A are joined to the channel irons 21 and 40 using bolts 41*a* and 42*a* and nuts 41*b* and 42*b*. The H-beams 11*b* and 14*b* of the inner frame 11B are joined to the channel irons 21 and 40 using bolts 43*a* and 44*a* and nuts 43*b* and 44*b*. The upper and lower guide parts 11G and 11*g* are identically assembled, are assigned the like reference numerals, and will not be described here.

Figure 11:
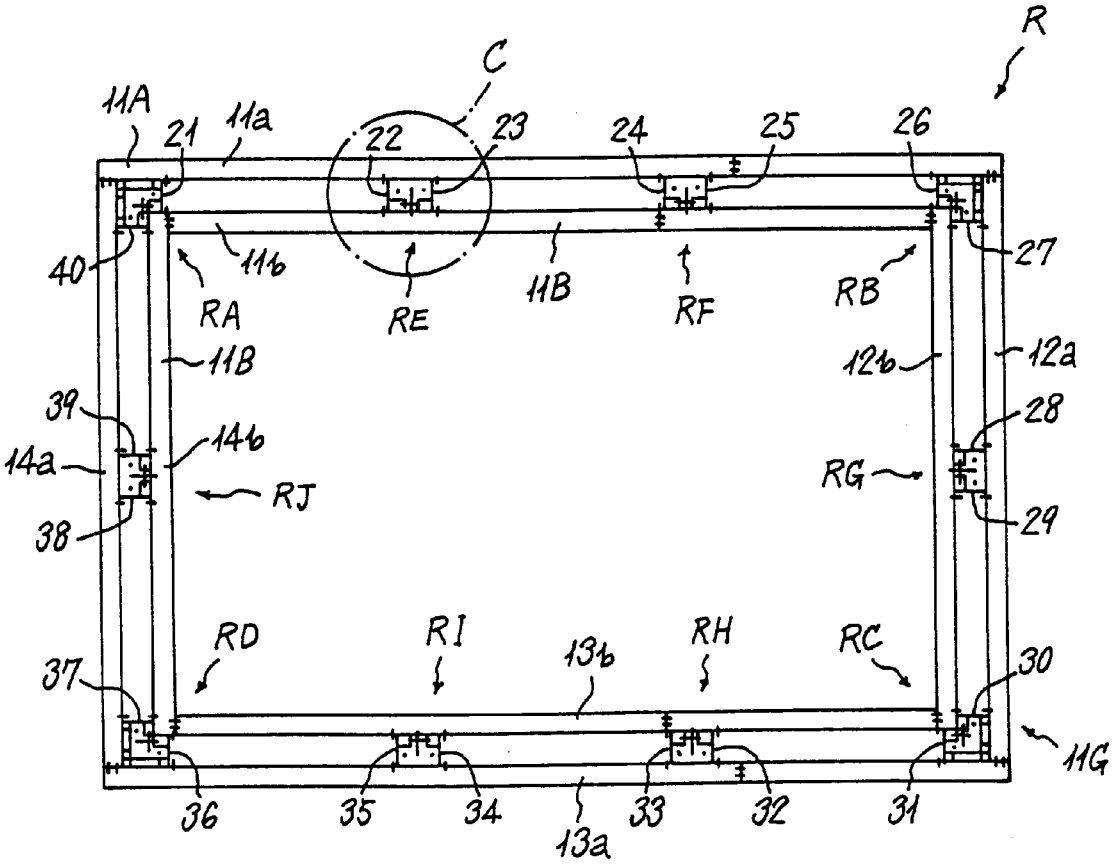
FIG. 11 is a top plan view of the guide.
Figure 12:
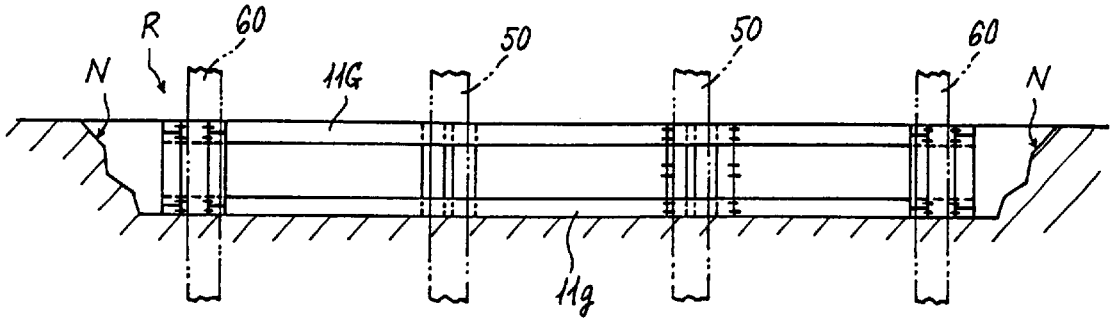
FIG. 12 is a side view of the guide.
Figure 16:
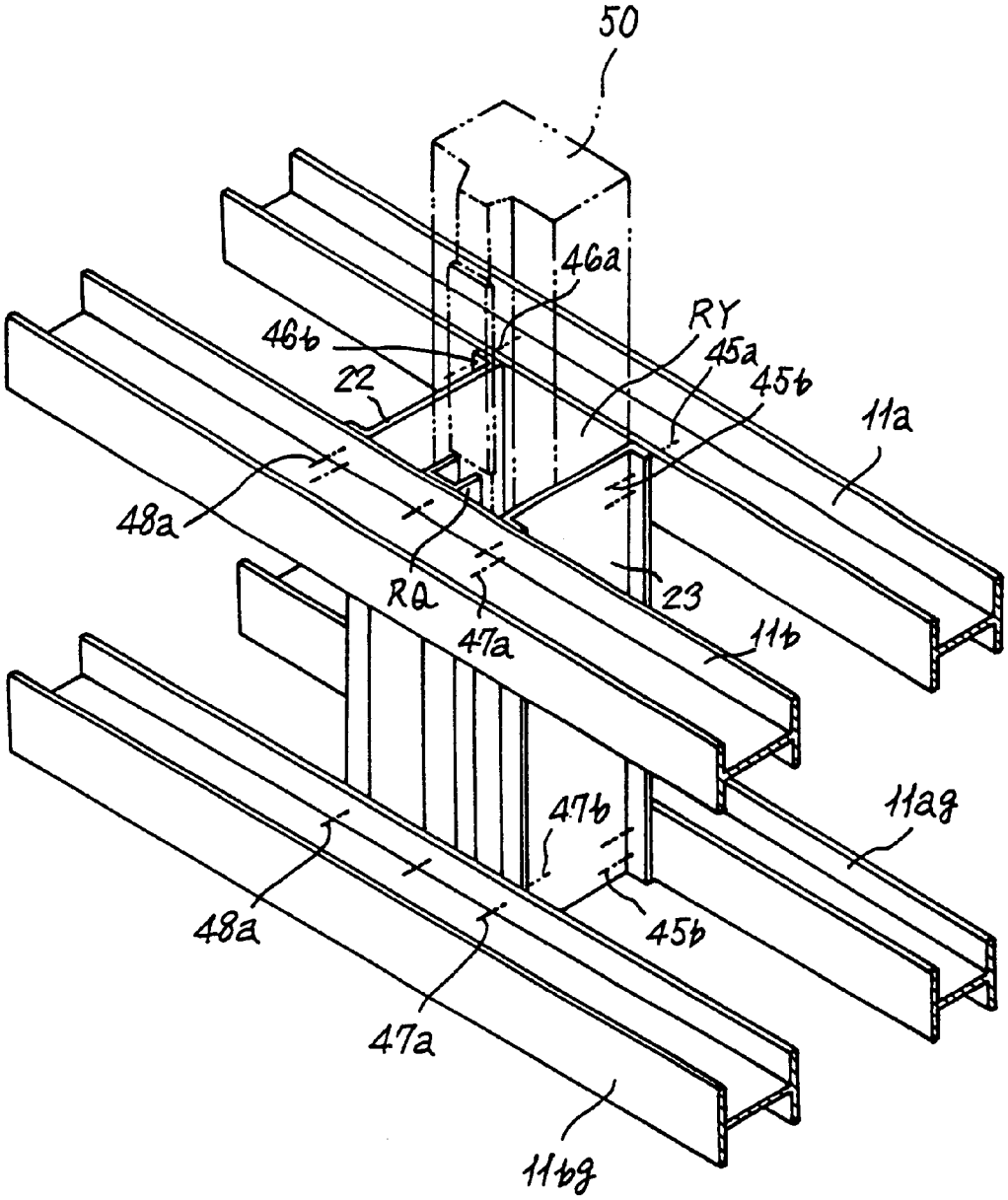
FIG. 16 is a perspective view of an intermediate part of the guide.
Figure 17:
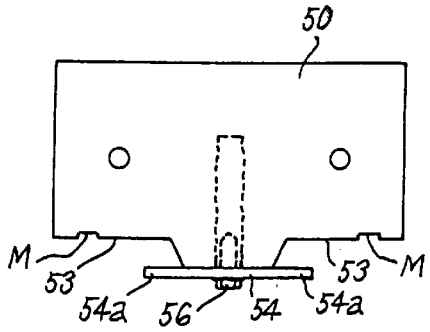
FIG. 17 is a top plan view of one example of a column provided between corners.
Figure 18:
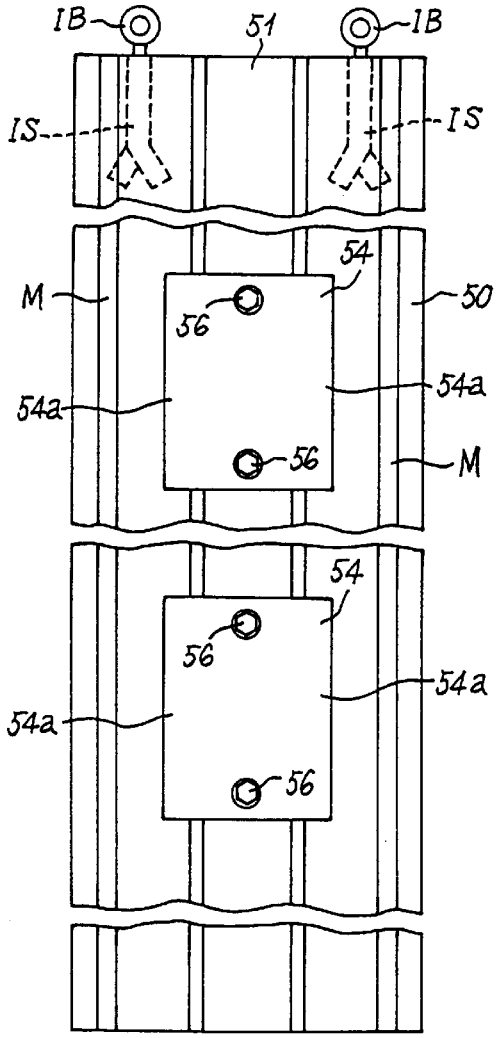
FIG. 18 is a front view of the column of FIG. 17

In the upper guide part 11G, the outer and inner frames 11A and 11B are joined between the columns at a part C shown in FIG. 11, as a typical example. Referring to FIGS. 13 and 16, the H-beam 11*a* of the outer frame 11A is joined to the channel irons 22 and 23 using bolts 45*a* and 46*a* and nuts 45*b* and 46*b*. The H-beam 11*b* of the inner frame 11B is joined to the channel irons 22 and 23 using bolts 47*a* and 48*a* and nuts 47*b* and 48*b*. The upper and lower guide parts 11G and 11*g* are identical, are assigned the like reference numerals, and will not be described here.

When the outer and inner frames 11A and 11B are assembled as described above, the guide R has hollow spaces RW (shown in FIGS. 13 and 15) at its four corners RA, RB, RC and RD. The corner columns 60 are fitted into the hollow spaces RW as described later. Further, the guide R is provided with guide holes RY (shown in FIGS. 13 and 16) at positions RE, RF, RG, RH, RI and RJ between the corners. The columns 50 are fitted into the guide holes RY as described later. In FIGS. 15 and 16, the foregoing bolts and nuts are depicted by dotted lines.

Referring to FIGS. 13 and 15, angle irons RK, RL, RM and RN are provided in the respective hollow spaces RW of the guide R in order to guide the corner columns 60 therein, and are welded to the guide R. A channel iron RQ is provided in the space RY at the part C in order to guide the column 50, and is bolted to the guide R.

(5) Installing and Fixing Columns

Figure 5:
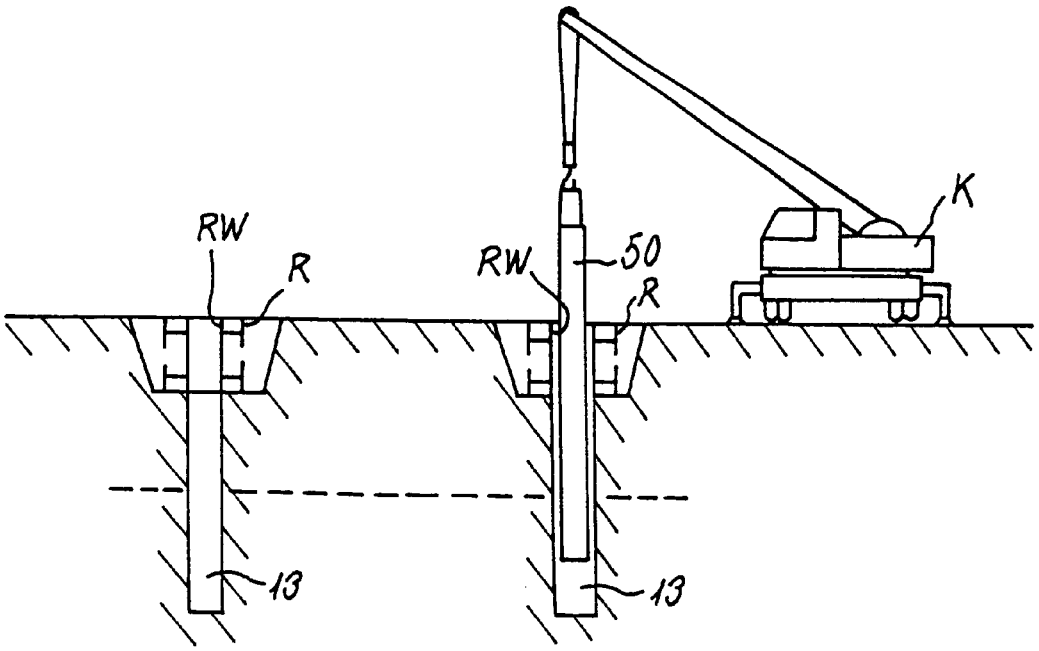
FIG. 5 shows how columns are installed and fixed.

The corner columns 60 (shown in FIG. 14) and columns 50 are guided into the spaces RW and RY (shown in FIG. 13) and fitted into the holes 13 using a crane of a wrecker truck K. The distances between the columns are accurately measured. Then, concrete is applied into the holes 13 to a level below the level shown by a broken line in FIG. 5 so that the columns 50 and 60 are fixedly supported in the holes 13. In this case, a short hose should be used in order to prevent concrete materials from being separated from one another. The guide R is used to reliably install the columns 60 and 50.

Each column 50 is substantially rectangular, and has a trapezoidal portion on its inner surface along its length as shown in FIGS. 17 to 20. The trapezoidal portion has a flat top 51 for receiving joints 54 to be described later. The column 50 is made of concrete and includes reinforcing rods having shapes of a rectangle and a corrugation, and a plurality of embedded inserts IS in the shape of a fork. Eye bolts IB are detachably screwed into the inserts IS when the column 50 is suspended by the crane.

A plurality of rectangular joints 54 having side edges 54*a* are attached on the top 51 of the trapezoidal portion of the column 50, using bolts 56 which are detachably attached to the inserts IS. The column 50 has a pair of grooves M along the opposite sides of the trapezoidal portion in order to receive a sealant.

Each corner column 60 is substantially in the shape of an L as shown in FIGS. 21 to 25, and has a part 62 in the shape of a step. The part 62 is engaged along its length with a plurality of joints 70 in the shape of a cross. Specifically, legs 71 and 72 of the joints 70 are fixed to the part 62 using bolts 65 having inserts. Each joint 70 has its legs 71 and 72 and portions 73 and 74 welded at its center. The corner column 60 includes reinforcing steel 67 having a shape of the L, and a plurality of inserts IS embedded at the top thereof, and is detachably engaged with eye bolts IB. The inserts IS have forked portions.

(6) Removal of the Outer Frame

When the columns 50 are fixed in the hole 13 after concrete is hardened, the outer frame 11A and channel irons 21 to 40 are removed from the trench N by releasing the bolts 43*a*, 44*a*, 47*a* and 48*a*, so that the panels 80 can be installed without any problem. Refer to FIG. 11. However, the inner frame 11B is left as it is since it is used as a support.

(7) Installation of the Panels and Digging an Area Defined by the Panels

The panels 80 are suspended by the crane of the wrecker truck K, and installed by matching the joints 81 and 82 (shown in FIGS. 29 and 31) thereof with the joints 54 and 70 of the columns. The space defined by the panels 80 is dug using the back hoe B. The panels 80 are moved down into the trench N which is manually dug at the bottom.

Figure 26:
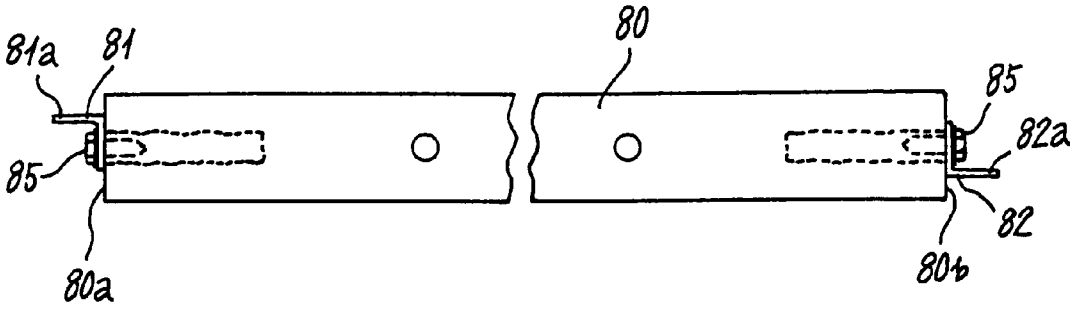
FIG. 26 is a top plan view of one example of a panel used for the invention.
Figure 27:
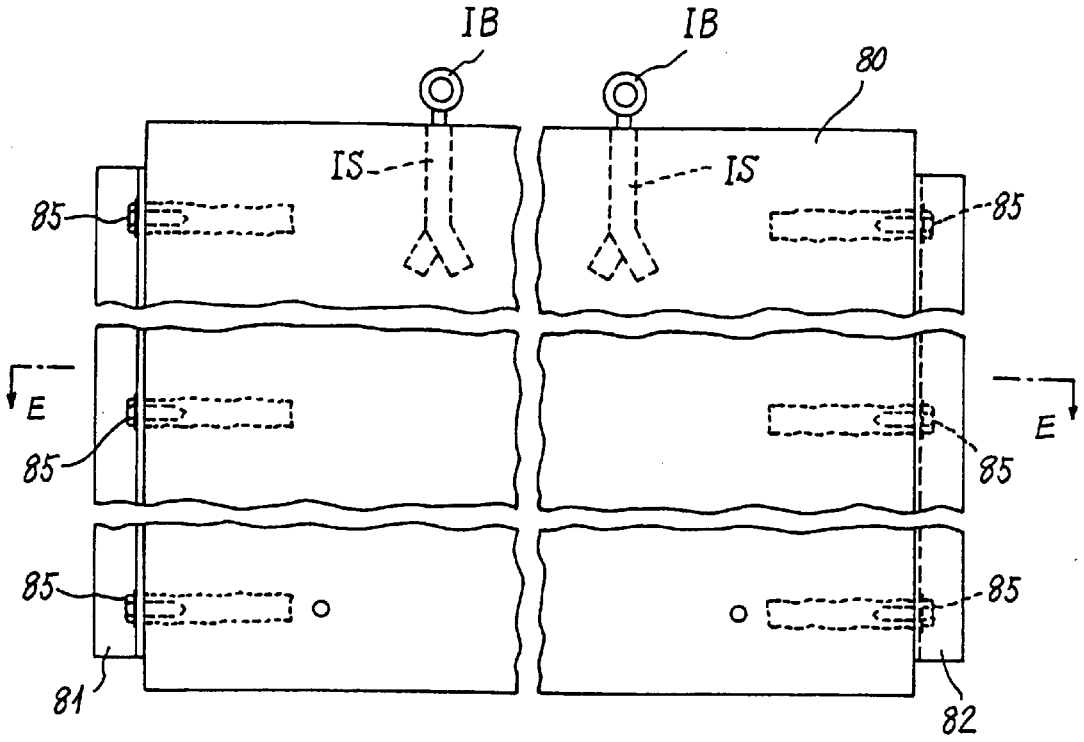
FIG. 27 is a front view of the panel.
Figure 28:
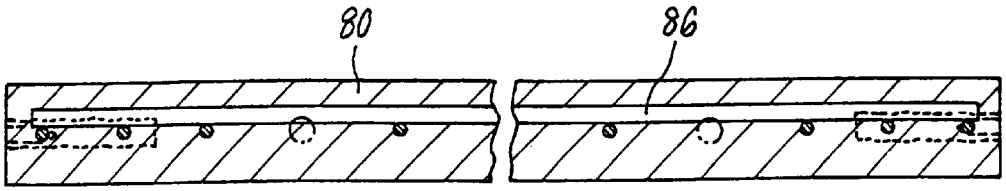
FIG. 28 is a cross section of the panel taken along line E—E in FIG. 27.

Each panel 80 is installed between the corner column 60 and the column 50 as shown in FIGS. 26 to 28, and includes an L-shaped joint 81 fixed at its one side edge 80*a* using bolts 85 having inserts. A free end 81*a* of the joint 81 faces to the exterior of the panel 80, and has a length in order to be fitted between the joint 54 and an inner surface 53 of the column 50 (see FIG. 31).

The panel 80 also has an L-shaped joint 82 fixed to the other side edges 80*b* using a bolt 85 having the insert. A free end 82*a* of this L-shaped joint 82 faces inward to the panel 80, and has a length in order to be fitted between the parts 71 and 72 of the joint 70 for the column 50 and the surface 63 of the corner column 60 (see FIG. 29). The panel 80 comes into contact with the corner column 60 via its side edge 80*b* and with the column 50 via its side edge 80*a*. A plurality of inserts IS having forked ends are embedded in the upper part of the panel 80, and are detachably engaged with eye bolts IB used for suspending the panel 80 using the crane.

The panel 80 is made of concrete and includes reinforcing steel 86 in the shape of a lattice. The panel 80 is usually installed between the corner column 60 and the column 50. However, when they are installed between the columns 50, they have joints facing outward.

Figure 29:
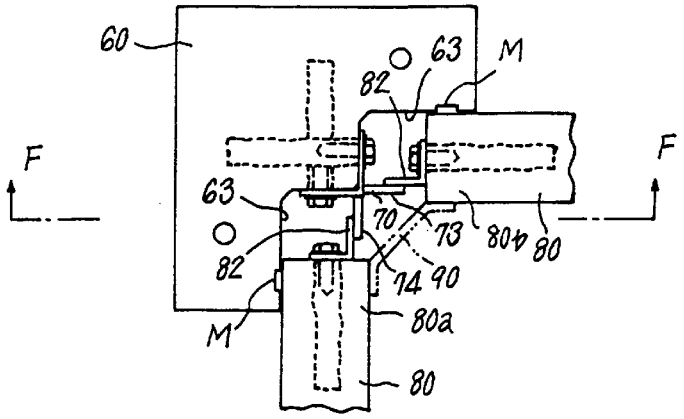
FIG. 29 shows the state in which panels are joined to the corner column.
Figure 30:
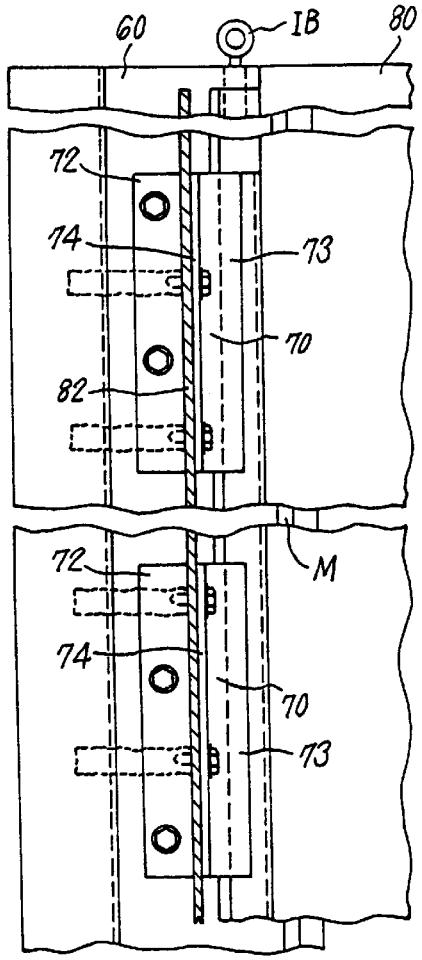
FIG. 30 is a longitudinal section taken along line F—F in FIG. 29.
Figure 31:
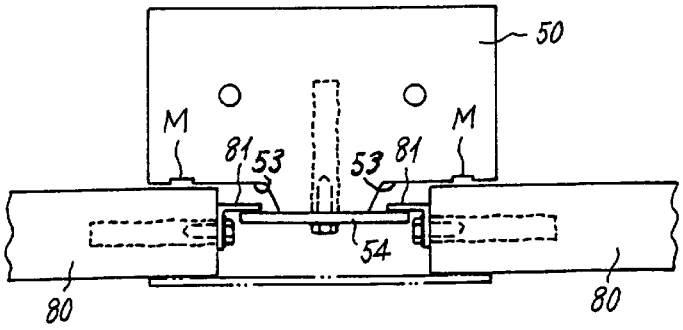
FIG. 31 is a top plan view showing the state in which panels are joined to the column provided between the corners.
Figure 32:
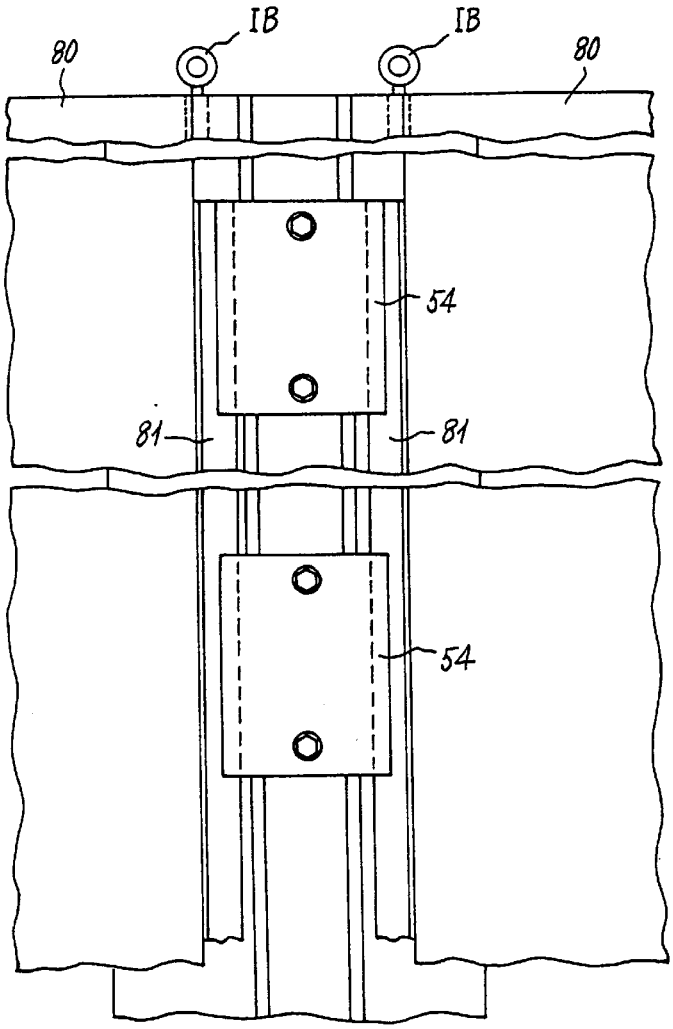
FIG. 32 is a front view showing the state in which panels are joined to the column provided between the corners.

Referring to FIGS. 29 and 30, the panel 80 is installed between the parts 73 and 74 of the joints 70 and the surfaces 63 of the corner column 60 in such that the side edge 80*b* and joint 82 of the panel 80 slide on the joints 72 and 73. Further, the panel 80 is installed between the part 54*a* of the joint 54 and the surfaces 53 of the column 50 such that the side edge 80*a* and joint 81 of the panel 80 slide on the joints 54 of the column 50, as shown in FIGS. 31 and 32.

Figure 33:
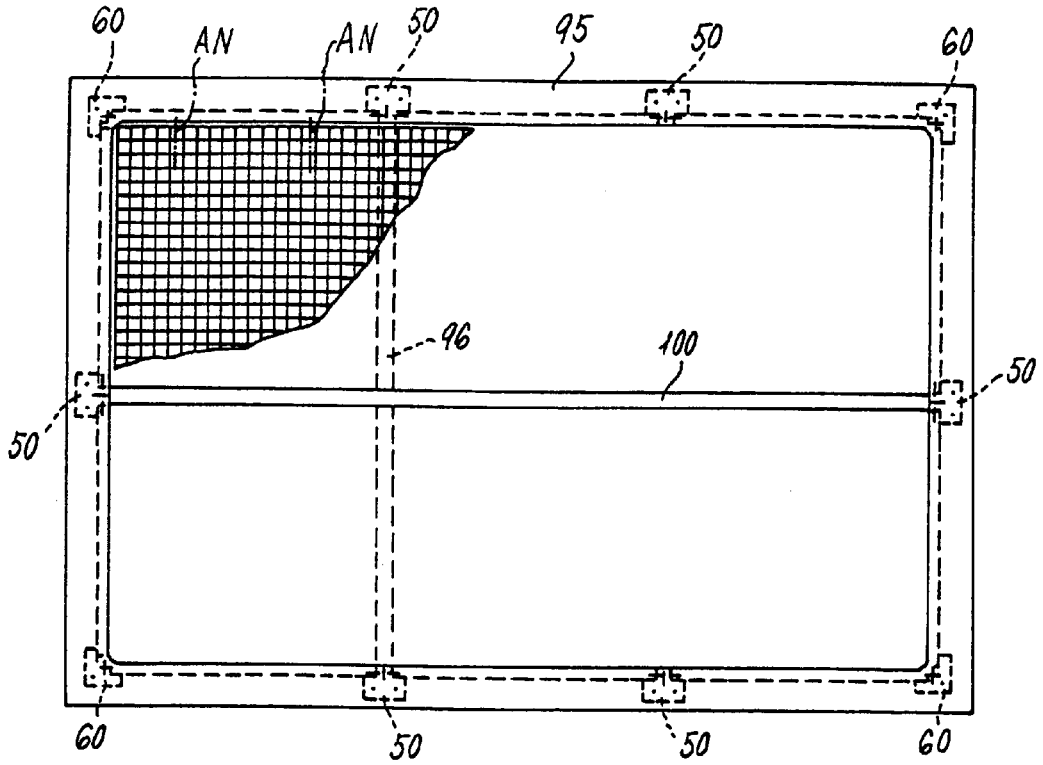
FIG. 33 is a top plan view of an underground structure built according to the method of the invention.
Figure 34:
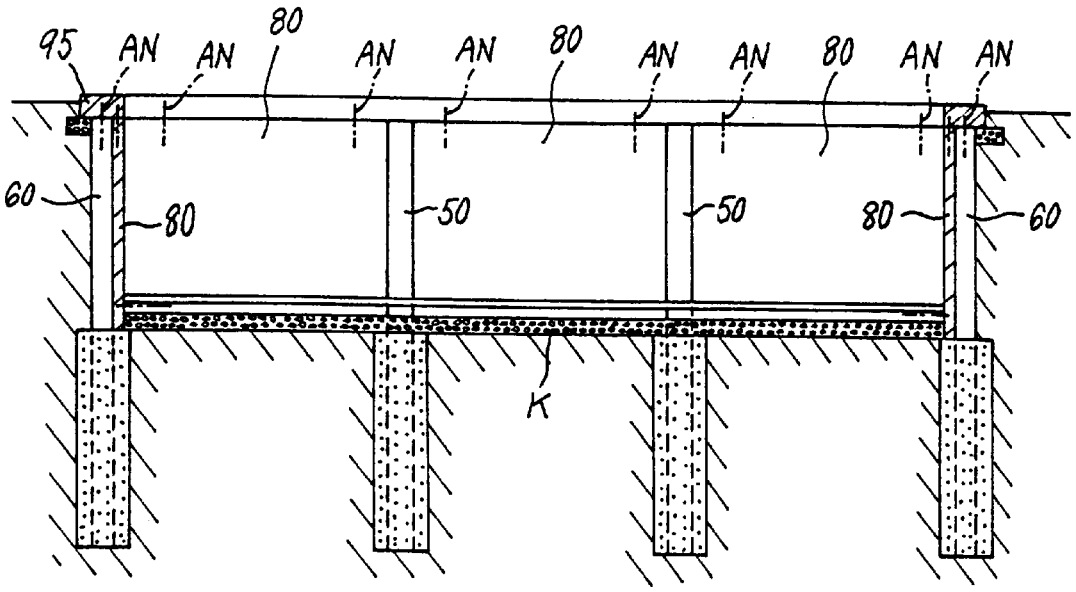
FIG. 34 is a longitudinal cross section of the center part of the underground structure.
Figure 35:
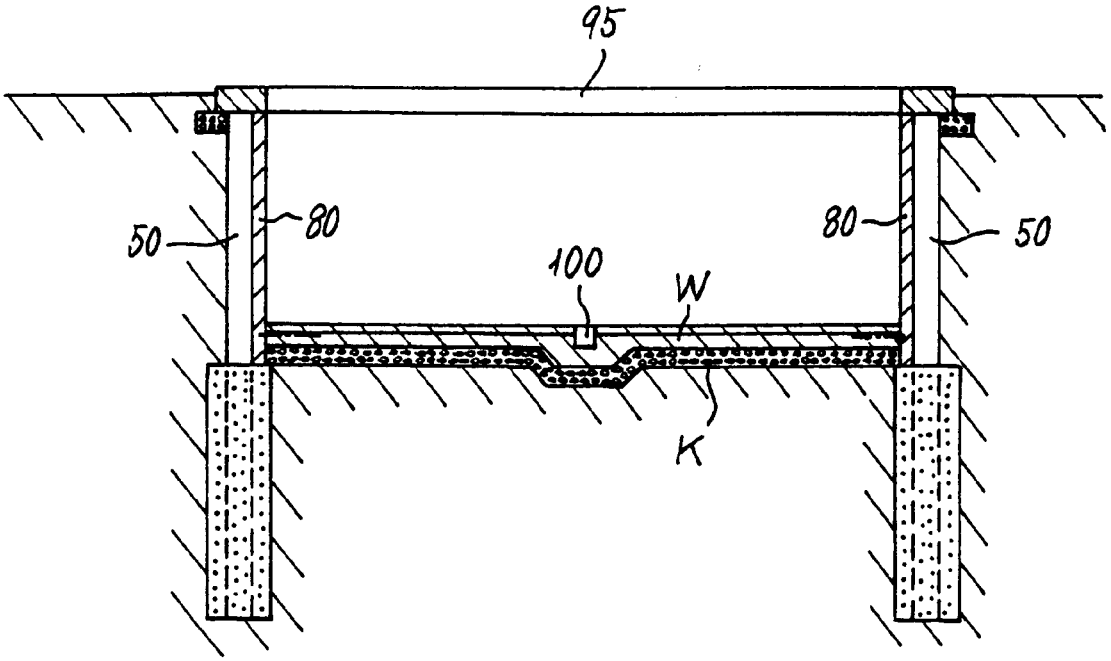
FIG. 35 is a lateral cross section of the center part of the underground structure.
Figure 36:
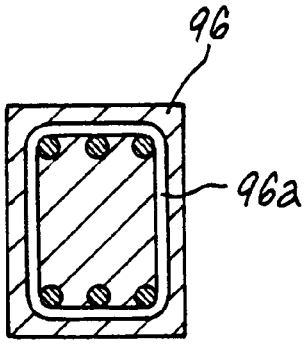
FIG. 36 is a cross section of a strut used for the method of the invention.

As shown in FIGS. 33 to 35, the underground structure is completed when the panels 80 are installed between the adjacent corner columns 60 and the columns 50. In this case, the underground structure is used to make an underground parking lot with three juxtaposed parking spaces and two-story mechanical lift.

(8) Making a Bottom Floor

Figure 8:
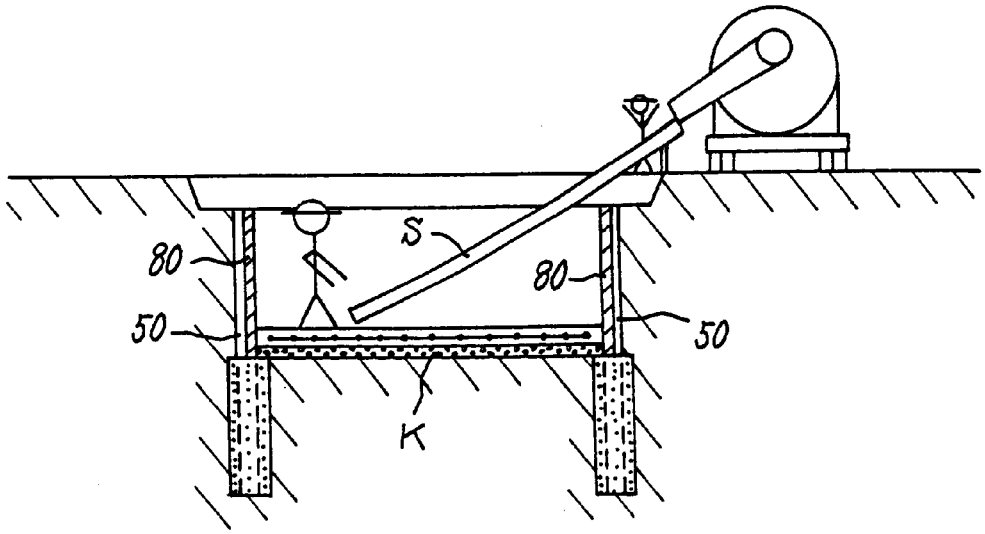
FIG. 8 shows how a bottom of the underground structure is made.

Referring to FIG. 8, the area defined by the panels 80 is readjusted. A base material K is uniformly applied to the readjusted space, which is then rammed. Anchors are hooked to the inserts embedded in the panels 80 in order to install reinforcing members. Then, concrete is applied onto the reinforcing members, thereby forming a bottom floor W (shown in FIG. 9) using a chute S. The concrete is finished using a metal trowel.

(9) Filling a Sealant and Mortar

A sealant such as foam rubber is filled into the gaps between the panels 80 and columns 60 and 50, i.e. especially in the grooves M so that the underground structure is protected against leaking water. Further, a frame 90 made of plywood or the like is inserted into the gaps between the side edges 80*a* and 80*b* of adjacent panels 80, and mortar is filled in the foregoing gaps (refer to FIGS. 29 and 31).

(10) Providing a Reinforcing Beam

Figure 10:
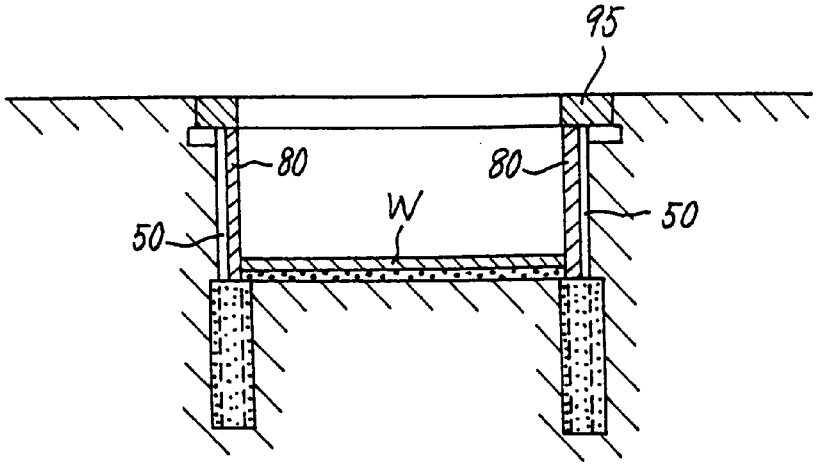
FIG. 10 shows removal of an inner frame of the guide shown in FIG. 1.

A base material of a reinforcing beam 95 is uniformly applied on the upper parts O of the columns 60 and 50 and panels 80. The eye bolts provided atop the columns 60 and 50 and panels 80 and used for suspending these members are replaced with reinforcing eye bolts. A reinforcing metal is placed on the base material, a frame for the reinforcing beam 95 is placed, and concrete is applied into the frame, thereby forming the reinforcing beam 95 (refer to FIG. 10).

If the underground structure is used to make a parking lot with three or more juxtaposed parking spaces and two-story lift, a plurality of struts 96 are provided across the upper parts of the columns 50 (see FIG. 33) in order to prevent the columns 50 from projecting inward due to ground pressure. The strut 96 is made of concrete and includes a rectangular reinforcing steel 96*a*.

Referring to FIGS. 33 to 35, the reinforcing beam 95 extends along the upper edges of the panels 80 and columns 60 and 50, and has a predetermined width in order to prevent the panels 80 from projecting inward due to the ground pressure. In these drawing figures, "AN" denotes anchor bolts.

(11) Removing the Inner Frame

After the reinforcing beam 95 is hardened, the inner frame 11B will be removed from the panels 80, and columns 60 and 50. In this state, the underground structure is completed according to the method of the invention.

Figure 6:
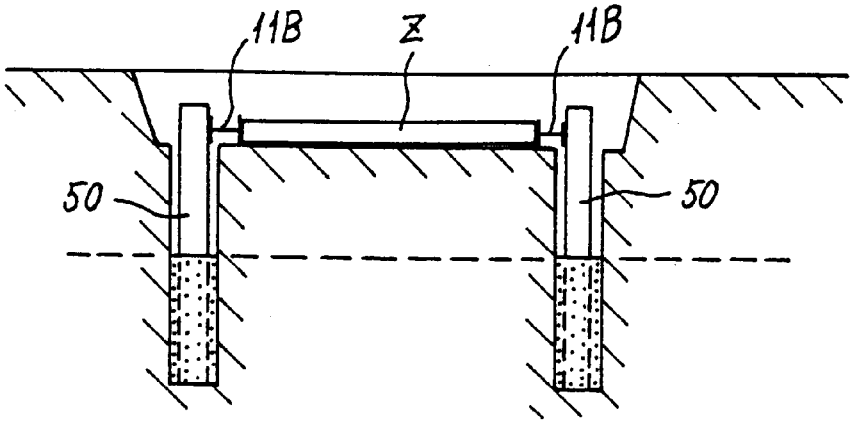
FIG. 6 shows removal of an outer frame of the guide.
Figure 7:
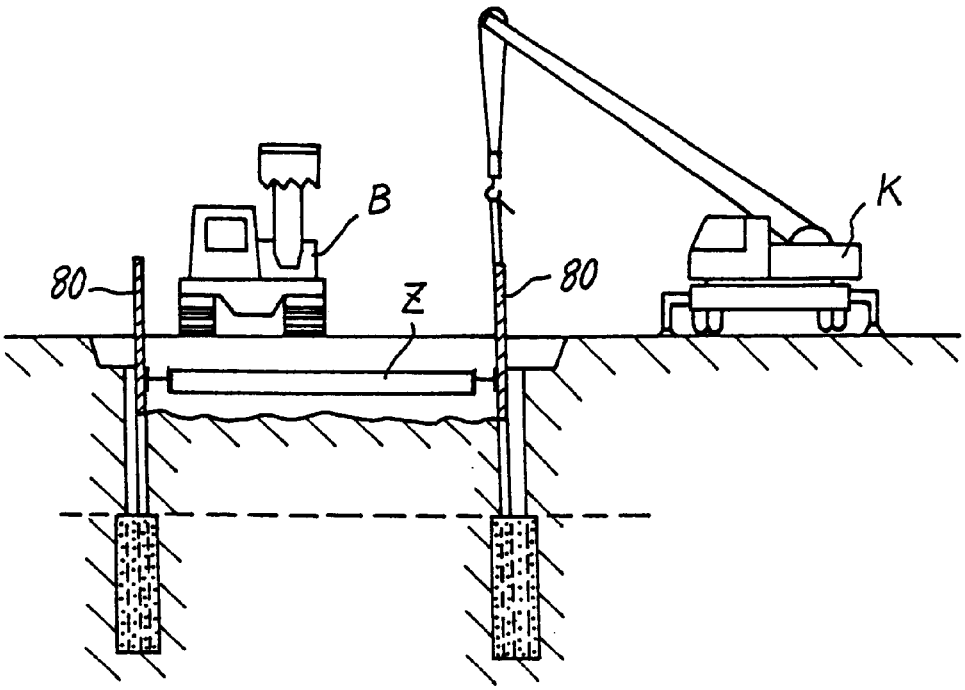
FIG. 7 shows installation of panels and digging a space defined by the panels.
Figure 9:
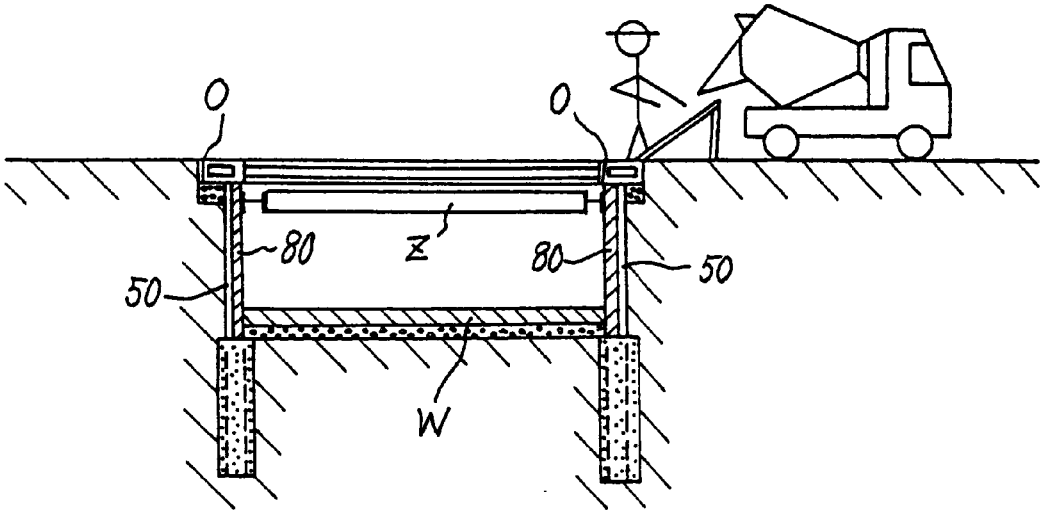
FIG. 9 shows construction of a reinforcing beam.

In FIGS. 6, 7 and 9, "Z" denotes temporary members.

Referring to FIGS. 33 and 35, the underground structure, i.e. three juxtaposed parking lots with the two-story mechanical lit, is composed of the columns 50 and 60, panels 80, and bottom W, and reinforcing beam 95. In these figures, reference numeral 100 denotes a drain.

Although the invention has been described with reference to the preferred embodiment, it should be noted that the invention may be modified without departing from the spirit and scope thereof. For instance, the method of the invention is applicable to building a parking lot with two to 14 juxtaposed parking spaces with two-story mechanical lift.

What is claimed is:

1. A method of building an underground structure using concrete columns to be vertically installed at corners and at positions between the corners and concrete panels to be fitted between adjacent concrete columns, the method comprising the steps of:

determining positions for installing the concrete columns, and digging a trench for burying a guide used for the concrete columns;

drilling holes for burying the concrete columns in the trench, the holes being deeper than a level where the concrete panels are placed;

assembling the guide, the guide being composed of outer and inner frames, and guide members for burying the concrete columns;

installing the concrete columns in the trench along the guide, and filling concrete in the holes to fix the concrete columns in the holes;

removing the outer frame of the guide;

deepening the trench, digging an area for the underground structure, and fitting the concrete panels between the concrete columns;

installing a reinforcing metal beam using concrete on the concrete columns and the concrete panels to prevent the concrete panels from projecting inward due to ground pressure; and removing the inner frame of the guide after the concrete of the reinforcing beam is solidified.

2. The method of claim 1, further comprising installing a mechanical two-story lift, wherein the underground structure is a parking lot with a mechanical two-story lift.

3. A method of building an underground structure using concrete columns to be vertically installed at corners and at positions between the corners and concrete panels to be fitted between adjacent concrete columns, the method comprising the steps of:

determining positions for installing the concrete columns, and digging a trench for burying a guide used for the columns;

drilling holes for burying the concrete columns in the trench, the holes being deeper than a level where the concrete panels are placed;

assembling the guide, the guide being composed of outer and inner frames, and guide members for burying the concrete columns;

installing the concrete columns in the trench along the guide, and filling concrete in the holes to fix the concrete columns in the holes;

removing the outer frame of the guide;

deepening the trench, digging an area for the underground structure, and fitting the concrete panels between the concrete columns;

installing a reinforcing metal beam using concrete on the concrete columns and the concrete panels to prevent the concrete panels from projecting inward due to soil pressure;

providing a bottom of the underground structure by applying concrete in an area enclosed by the concrete panels; and removing the inner frame of the guide after the concrete of the reinforcing beam is solidified.

4. The method of claim 3, further comprising installing a mechanical two-story lift, wherein the underground structure is a parking lot with a mechanical two-story lift.

5. A method of building a cellar using concrete columns to be vertically installed at corners and at positions between the corners and concrete panels to be fitted between adjacent concrete columns, the method comprising the steps of:

determining positions for installing the concrete columns, and digging a trench for burying a guide used for the columns;

drilling holes for burying the concrete columns in the trench, the holes being deeper than a level where the concrete panels are placed;

assembling, the guide having outer and inner frames, and guide members for burying the concrete columns;

installing the concrete columns in the trench along the guide, and filling concrete in the holes to fix the concrete columns in the holes;

removing the outer frame of the guide;

deepening the trench, digging an area for the underground structure, and fitting the concrete panels between the concrete columns;

filling a water sealant in spaces between the concrete panels and the concrete columns, installing frames in spaces between ends of adjacent concrete panels, and filling mortar in spaces between the concrete panels;

installing a reinforcing metal beam using concrete on the concrete columns and the concrete panels to prevent the concrete panels from projecting inward due to ground pressure; and removing the inner frame of the guide after the concrete of the reinforcing beam is solidified.

* * * * *

UNITED STATES PATENT AND TRADEMARK OFFICE

CERTIFICATE OF CORRECTION

PATENT NO. : 6,332,303 B1
DATED : December 25, 2001
INVENTOR(S) : Saito

It is certified that error appears in the above-identified patent and that said Letters Patent is hereby corrected as shown below:

Title page, Item [54], and Column 1, lines 1-2,
The title should read -- [54] METHOD OF BUILDING AN UNDERGROUND STRUCTURE USING CONCRETE COLUMNS AND PANELS, TEMPORARY FRAMES, METAL BEAMS TO PREVENT BUCKLING, AND POURED CONCRETE --

Signed and Sealed this

Fourth Day of June, 2002

*Attest:*

*Attesting Officer*

JAMES E. ROGAN
*Director of the United States Patent and Trademark Office*